US006440005B1

(12) United States Patent
Hubenig

(10) Patent No.: US 6,440,005 B1
(45) Date of Patent: Aug. 27, 2002

(54) GOLF CLUB

(75) Inventor: Ronald Jacob Hubenig, Surrey (CA)

(73) Assignee: Peter MacLean Chancey, Delta (CA)

( * ) Notice: Subject to any disclaimer, the term of this patent is extended or adjusted under 35 U.S.C. 154(b) by 0 days.

(21) Appl. No.: 09/441,399

(22) Filed: Nov. 16, 1999

(51) Int. Cl.[7] ..... A63B 53/04
(52) U.S. Cl. ..... 473/228; 473/232; 473/327
(58) Field of Search ..... 473/226, 227, 473/228, 317, 327, 316, 324, 232, 234, 235; 273/FOR 186.2; 446/62, 67, 61; D21/742, 745; 244/113

(56) References Cited

U.S. PATENT DOCUMENTS

| | | | | | |
|---|---|---|---|---|---|
| 2,626,151 | A | | 1/1953 | Jenks | 273/35 |
| 3,565,444 | A | * | 2/1971 | LaRocca | 273/186 |
| 4,576,378 | A | * | 3/1986 | Backus | 273/186 A |
| 5,310,188 | A | | 5/1994 | Hernberg | 273/186.2 |
| 5,318,297 | A | | 6/1994 | Davis et al. | 273/80.2 |
| 5,335,918 | A | * | 8/1994 | Rupnik | 273/186.2 |
| 5,395,107 | A | * | 3/1995 | De Pippo | |
| 5,415,406 | A | * | 5/1995 | Reichenbach | 273/186.2 |
| 5,511,786 | A | | 4/1996 | Antonious | 473/327 |
| 5,571,048 | A | | 11/1996 | Kenney | 473/228 |
| 6,238,299 | B1 | * | 5/2001 | Barnette | |

* cited by examiner

*Primary Examiner*—Stephen Blau
(74) *Attorney, Agent, or Firm*—Kolisch Hartwell Dickinson McCormack & Heuser

(57) ABSTRACT

A small fin extends radially aft from a golf club head to resist rotation of a golf club shaft about its longitudinal axis. The fin is aligned relative to the club head so as to produce minimum drag when the club is drawn smoothly through the desired arc without rotating the club shaft about its longitudinal axis. Rotation of the shaft about its longitudinal axis displaces the fin from its minimum drag position and hence puts the fin in disequilibrium, such that the drag is greater on the side of the fin that would urge the fin back into its equilibrium position, thereby rotating the shaft back into its correct position.

12 Claims, 2 Drawing Sheets

GOLF CLUB

BACKGROUND OF THE INVENTION

1. Field of the Invention

The present invention relates to golf clubs, and more particularly to clubs that resist movement that would induce a hook or a slice in a golf ball struck with the club.

2. Background

Proper alignment between a golf ball, a golf club, and a golfer is the key to hitting the ball along a straight path. Even slight misalignment can induce an undesirable spin in the ball, causing it to veer dramatically to the inside (hooking) or to the outside (slicing). To avoid these undesirable consequences, the golfer must strike the club face squarely through the ball, by smoothly drawing the club downward through an arc without rotating the club shaft about its longitudinal axis.

Regrettably, it would seem that this movement is not natural for most golfers, and years of practice are necessary to enable them to reproduce this stroke with any degree of regularity. Unsurprisingly, many inventors have turned their minds to mechanisms for training golfers to reproduce such a stroke or for urging clubs to follow a desired swing-path.

For example, U.S. Pat. No. 2,626,151 granted in 1953 for a "Golf Practice Apparatus" illustrates a complicated combination of wheels, shafts, and restraints for causing a golfer to adopt a predetermined stance and to swing a club through a predetermined path. Unfortunately, the '151 apparatus appears both cumbersome and complicated and is ill-adapted for use on an actual golf course.

It is also well known to attach to, or incorporate into, a golf club shaft either a fin for introducing aerodynamic drag or an airfoil for introducing aerodynamic lift. These devices are intended to alter the path of a golf club in various ways that the inventors imagine to be advantageous. Examples include U.S. Pat. No. 5,335,918 granted to Thomas J. Rupnik et al on Aug. 9, 1994 for a "Golf Club Swing Training Device", U.S. Pat. No. 5,571,048 granted to Lawrence D. Kenney on Nov. 5, 1996 for a "Golf Swing Practice Device", U.S. Pat. No. 5,310,188 granted to Joseph G. Hernberg on May 10, 1994 for a "Golf Club Swing Alignment Device", and U.S. Pat. No. 5,415,406 granted to Roy A. Reichenbach et al on May 16, 1995 for a "Golf Club Swing Training Device". Unfortunately, each of these devices is quite large with respect to the golf club itself. The fins and airfoils are generally elongated and extend along a substantial portion of the shaft in order to achieve whatever aerodynamic effect is desired. The devices are thus cumbersome and ill-suited for use during a golf game, and generally tend to make the golfer appear foolish.

Less obtrusive airfoils are also known and are generally incorporated into the head of a golf club. Examples of such airfoils includes those taught in U.S. Pat. No. 5,318,297 granted to Stephen Davis et al on Jun. 7, 1994for a "Golf Club" and in U.S. Pat. No. 5,511,786 granted to Anthony J. Antonious on Apr. 30, 1996 for a "Wood Type Aerodynamic Golf Club Head Having an Air Foil Member on the Upper Surface". Such airfoils are asserted either to affect the elevation of the club head or to reduce the drag of the club head, to permit it to be swung at a higher velocity. These airfoils are not configured to resist rotation of the shaft.

SUMMARY OF THE INVENTION

What is needed therefore, is an unobtrusive device for urging a golf club along an appropriate path when swung by a golfer, and in particular to resist rotation of the golf club shaft along its longitudinal axis.

The present invention is directed to such a solution.

In one embodiment of the present invention, a small fin extends radially from the neck portion of a golf club head. The fin is aligned relative to the club head so as to produce minimum drag when the club is drawn smoothly through the desired arc without rotating the club shaft about its longitudinal axis. Rotation of the shaft about its longitudinal axis displaces the fin from its minimum drag position and hence puts the fin in disequilibrium, such that the drag is greater on the side of the fin that would urge the fin back into its equilibrium position, thereby rotating the shaft back into its correct position.

The fin may be located generally on the club head or shaft; however, desirably it is located on the neck portion of the club head for a number of reasons. First, the club head travels faster than the rest of the club during a golf swing and hence a small fin so located can generate a larger aerodynamic effect than one placed elsewhere, for example on the shaft. Second, this location is a pivot point between the shaft and the head, so that fine adjustments at this pivot point will compensate for larger displacements in the club head or shaft. Third, this location permits the fin to be rotated about the longitudinal axis of the shaft to adjust for a golfer's particular swing characteristics.

BRIEF DESCRIPTION OF THE DRAWINGS

These and other features and advantages of the present invention will be better understood with reference to the following claims, detailed description, and accompanying drawings, in which:

DETAILED DESCRIPTION

Figure 1:
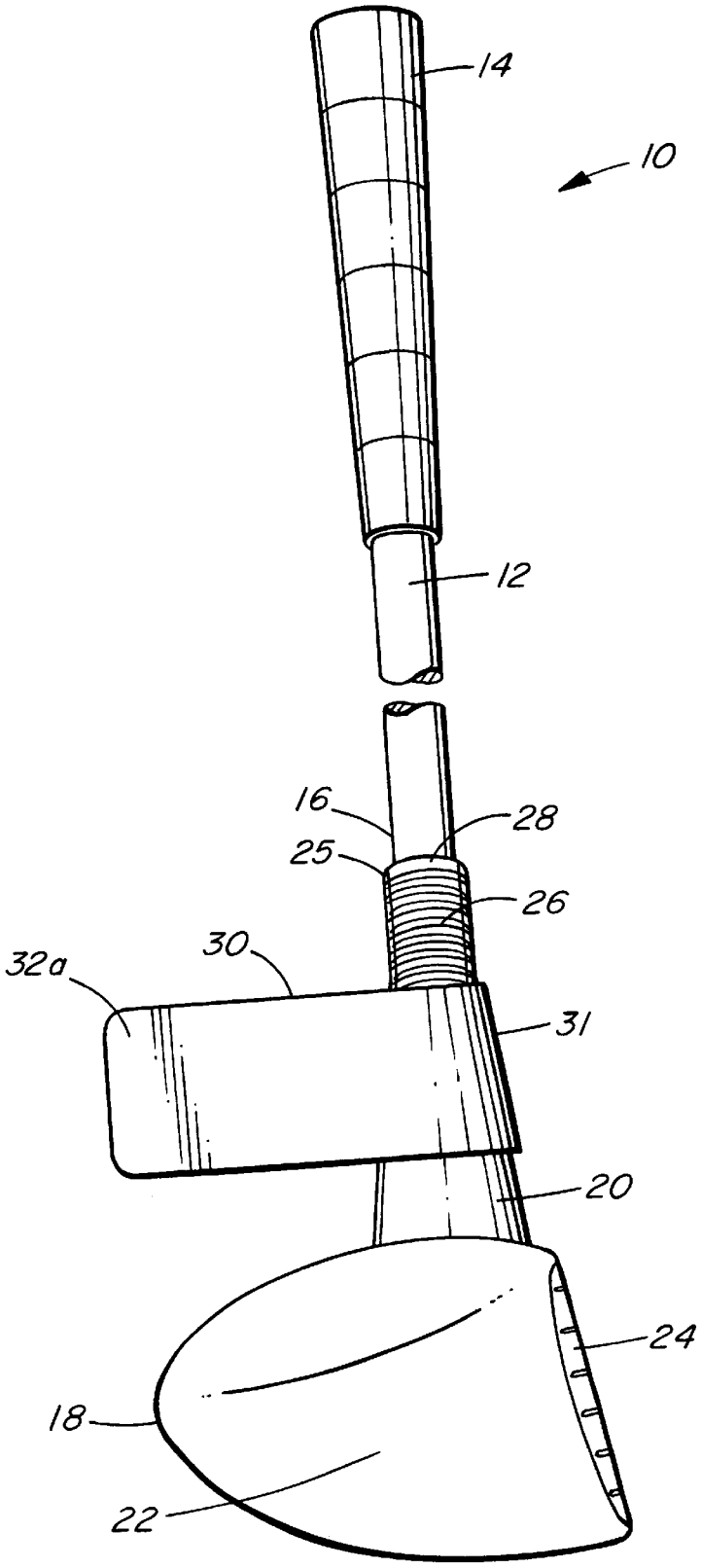
FIG. 1 is a front elevation of a golf club according to one embodiment of the invention.
Figure 2:
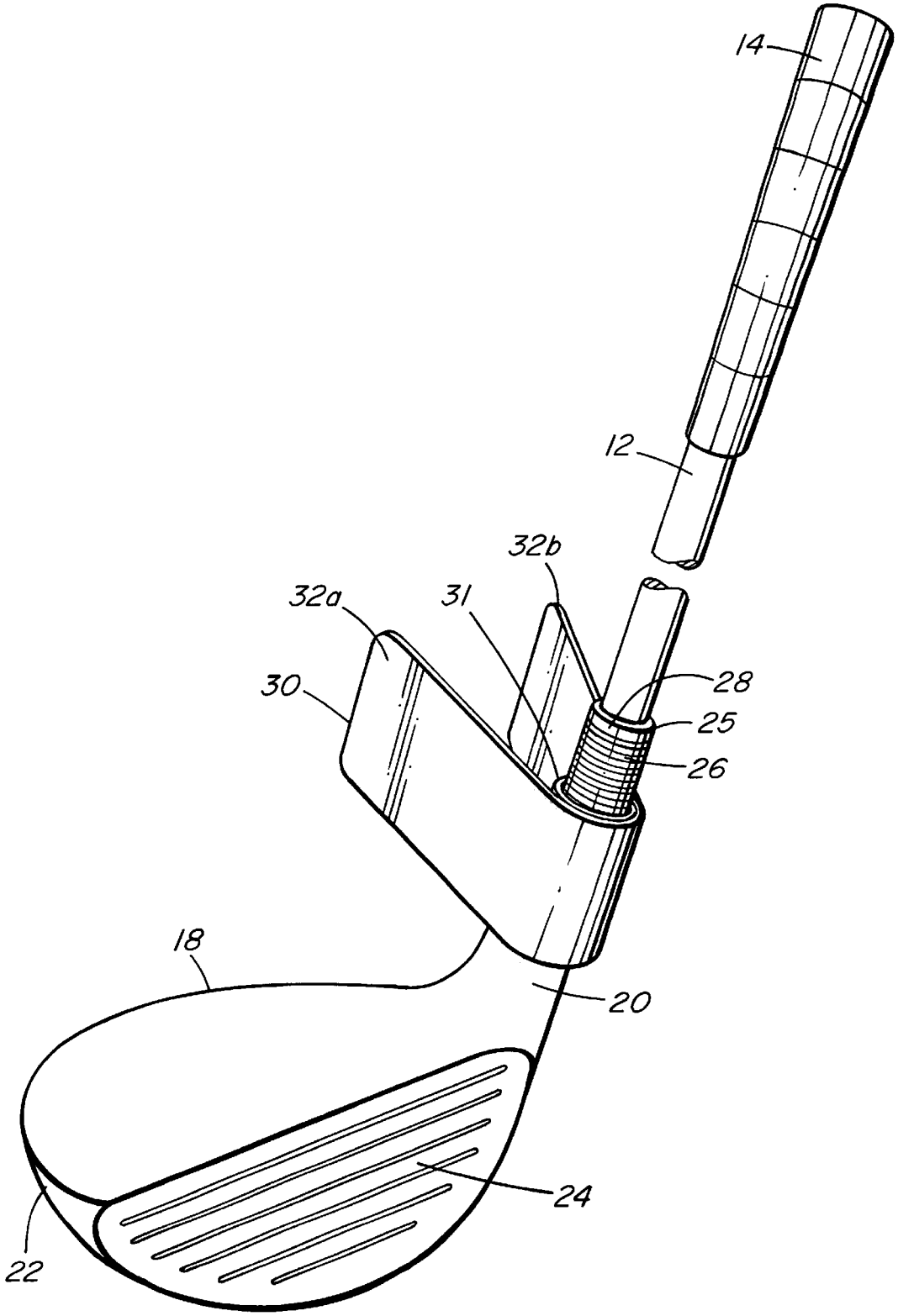
FIG. 2 is a perspective side view detailing the club of FIG. 1.

FIGS. 1 and 2 illustrate a golf club according to one embodiment of the present invention. The golf club, generally illustrated at 10, includes an elongated shaft 12 having a grip end 14 and an opposite head end 16. A club head 18 is attached to the head end 16 of the shaft 12, the head 18 having a neck portion 20 proximate to the shaft 12 and an opposite toe portion 22. A face 24 for striking a ball extends between the neck portion 20 and the toe portion 22. As illustrated, the golf club 10 is a wood; however it might also be an iron or any other sort of club.

The neck portion 20 defines a hosel 25 for receiving therewithin the head end 16 of the shaft 12. The shaft 12 is secured within the hosel 25 by whipping 26 and a ferrule 28.

A fin 30 extends from the club head 18, proximate to the neck portion 20. The fin 30 might either engage the head 18 or alternatively extend from the head 18 as an integral portion. Preferably, however, the fin 30 is adapted to rotate with user-applied force about the longitudinal axis of the neck portion 20 and the shaft 12.

As illustrated in this embodiment, the fin 30 is V-shaped, having at its vertex a coupler 31 that engages the neck portion 20 of the head 18 and presenting substantially symmetrical drag members 32*a*, 32*b* aft of the club head 18. It will be appreciated, however, that other fin configurations would also fall within the scope of the invention. For example, a fin that presents either more or less drag members would also work so long as it possessed sufficient symmetry. Desirably, the fin 30 is alignable relative to the club head 18 so as to produce minimum drag when the club 10 is drawn smoothly through a desired arc, without the club shaft 12 rotating about its longitudinal axis. Rotation of the shaft 12 about its longitudinal axis would displace the fin 30 from its minimum drag position so as to put the fin 30 in a state of disequilibrium, such that the drag is greater on that drag element 32*a*,32*b* or that surface of the drag element 32*a*,32*b* that would urge the fin 30 back into its equilibrium position, thereby rotating the shaft 12 back into its correct position. The fin 30 should thus be configured so that the re-equilibrilizing drag forces are both necessary and sufficient to return the fin 30 to its minimum drag position.

The fin 30 may be located generally on the club head 18 or the club shaft 12. Nevertheless, the fin 30 is desirably located on the neck portion 20 of the club head for a number of reasons. First, the club head 18 travels faster than the rest of the club 10 during a golf swing and hence a small fin 30 so located can generate a larger aerodynamic effect than could one placed elsewhere, for example, on the shaft 12. Second, the neck portion 20 is a pivot point between the shaft 12 and the head 18, so that fine adjustments at this pivot point will compensate for larger displacements in the club head 18 or the shaft 12. Third, this location permits the fin 30 to be rotated about the longitudinal axis of the shaft 12, to adjust for a golfer's particular swing characteristics.

OPERATION

Once the golfer has established an appropriate grip on the club shaft 12 at the grip end 14, he has constrained the plane through which the club 10 will travel during a proper golf swing. More particularly, so long as he maintains his grip and locks his wrists, the club shaft 12 should not rotate about its longitudinal axis and the club should travel through a smooth arc, much like a pendulum.

With this constraint established, the fin 30 may be rotated about the longitudinal axis of the neck portion 20 of the club head 18 to orient the fin 30 in its minimum drag position, that is, the position in which the drag members 32*a*, 32*b* present the minimum drag surfaces when the club is swing through the predetermined arc.

During the golfer's swing of the club 10, he may mistakenly unlock his wrists or ease up on his grip, resulting in the club shaft 12 rotating about its longitudinal axis. In such event, one of the drag members 32*a*, 32*b* will present a larger drag surface and the other drag member 32*b*, 32*a* will present a smaller drag surface than when the fin 30 is in its minimum drag position. The drag forces on the drag members 32*a*, 32*b* will therefore not be in equilibrium, and will urge the fin 30 back into its equilibrium position, thereby urging the shaft 12 to rotate oppositely about its longitudinal axis and back into the predetermined position.

While specific embodiments of the invention have been described and illustrated, such embodiments should be considered illustrative of the invention only and not as limiting the invention as construed in accordance with the accompanying claims.

What is claimed is:

1. An apparatus, comprising:

a) a first drag member and a second drag member oblique to the first drag member; and b) a coupler adapted to connect the first and second drag members to a golf club having a club head such that the first and second drag members extend substantially aft of the club head, whereby the first and second drag members act to apply a force to the club head during a swing to urge the club back toward a predetermined path wherein said apparatus has only two drag members.

2. An apparatus as claimed in claim 1, wherein the club head has a neck portion and the coupler engages the neck portion.

3. An apparatus as claimed in claim 2, wherein the coupler engages the neck portion such that the first and second drag members extend substantially perpendicular to the longitudinal axis of the neck portion.

4. An apparatus as claimed in claim 1, wherein the coupler rotatably engages the golf club.

5. An apparatus, comprising:

a) a club head connected to the head end of a shaft;

b) a first drag member extending substantially aft of the club head; and c) a second drag member oblique to the first drag member, such that the second drag member extends substantially aft of the club head, whereby the first and second drag members act to apply a force to the club head during a swing to urge the club back toward a predetermined path wherein said apparatus has only two drag members.

6. An apparatus as claimed in claim 5, wherein the club head has a neck portion and the first and second drag members extend from the neck portion.

7. An apparatus as claimed in claim 6, wherein the first and second drag members extend substantially perpendicular to the longitudinal axis of the neck portion.

8. An apparatus as claimed in claim 6, wherein the first and second drag members rotatably engage the club head.

9. A method, comprising:

a) aligning a first drag member and a second drag member oblique to the first drag member, substantially aft of a golf club head, such that when the club is swung through a predetermined path drag forces on the first and second drag members are in equilibrium, but when the club is swung through a path other than the predetermined path drag forces on the first and second drag members are in disequilibrium and urge the club back toward the predetermined path wherein there are only two drag members.

10. A method as claimed in claim 9, wherein aligning includes mounting the first and second drag members to a neck portion of the club head.

11. A method as claimed in claim 10, wherein aligning includes rotating the first and second drag members about the longitudinal axis of the neck portion.

12. A method as claimed in claim 11, wherein aligning includes extending the first and second drag members substantially perpendicular to the longitudinal axis of the neck portion.

* * * * *